US007207840B2

(12) United States Patent
Fukushima et al.

(10) Patent No.: US 7,207,840 B2
(45) Date of Patent: Apr. 24, 2007

(54) PLUG AND WATERPROOF CONNECTOR WITH PLUG

(75) Inventors: Hirotaka Fukushima, Haibara-gun (JP); Takashi Tsukamoto, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/181,865

(22) Filed: Jul. 15, 2005

(65) Prior Publication Data

US 2006/0019535 A1 Jan. 26, 2006

(30) Foreign Application Priority Data

Jul. 20, 2004 (JP) ..... P2004-211332

(51) Int. Cl.
*H01R 13/40* (2006.01)

(52) U.S. Cl. ..... 439/589

(58) Field of Classification Search ..... 439/589, 439/274, 275, 587
See application file for complete search history.

(56) References Cited

U.S. PATENT DOCUMENTS 4,895,533 A * 1/1990 Yagi et al. ..... 439/587
5,295,865 A * 3/1994 Endo et al. ..... 439/587
5,356,312 A * 10/1994 Abe et al. ..... 439/587

FOREIGN PATENT DOCUMENTS

JP 2001-273953 A 10/2001

* cited by examiner

*Primary Examiner*—Neil Abrams
*Assistant Examiner*—Phuongchi Nguyen
(74) *Attorney, Agent, or Firm*—Sughrue Mion, PLLC

(57) ABSTRACT

A waterproof connector includes annular plug receiving chambers formed within a connector housing in surrounding relation respectively to outer peripheral surfaces of insulating sheaths of wires, and are disposed adjacent respectively to terminal receiving chambers in a longitudinal direction of the wires, plugs received respectively in the plug receiving chambers, and a cover attached to the connector housing from a side of the other end portions of the wires, covering the plug receiving chambers. The plug includes an annular elastic rubber member and an annular resin member molded integrally with the rubber member in concentric relation thereto. An inner peripheral surface of the rubber member is held in contact with a part of the outer peripheral surface of the insulating sheath of the wire over an entire periphery thereof, while an outer peripheral surface of the rubber member is held in contact with an inner peripheral surface of a peripheral wall of the plug receiving chamber over an entire periphery thereof.

11 Claims, 9 Drawing Sheets

PLUG AND WATERPROOF CONNECTOR WITH PLUG

BACKGROUND OF THE INVENTION

This invention relates to a waterproof connector provided with plugs serving as liquid intrusion prevention members for preventing a liquid such as water and oil from intruding into terminal receiving chambers through a rear end of a connector housing from which wires, connected respectively to terminals received in the respective terminal receiving chambers, extend outwardly. The invention also relates to this plugs.

There is known a related waterproof connector provided with plugs serving as liquid intrusion prevention members for preventing the intrusion of a liquid such as water and oil. This related waterproof connector includes a connector housing, terminal receiving chambers formed within the connector housing, terminals received respectively in the terminal receiving chambers, wires having their one end portions electrically connected respectively to the terminals and having the other end portions extended outwardly from the connector housing, annular plug receiving chambers formed within the connector housing in surrounding relation respectively to outer peripheral surfaces of the wires and disposed adjacent respectively to the terminal receiving chambers in the longitudinal direction of the wires, annular plugs received respectively in the plug receiving chambers, and a cover attached to the connector housing from a side of the other end portions of the wires and covering the plug receiving chambers. An inner peripheral surface of the plug is held in contact with a part of an outer peripheral surface of the wire over an entire periphery thereof, while an outer peripheral surface of the plug is held in contact with an inner peripheral surface of a peripheral wall of the plug receiving chamber, which forms outline of this plug receiving chamber, over an entire periphery thereof. The plug is made 100 percent of rubber (synthetic rubber), and has elasticity, and therefore the plug is held in contact with the wire, so that the plug supports this wire, thereby preventing the terminal, connected to this wire, from shaking within the terminal receiving chamber (see Patent Literature 1).

Patent Literature 1:JP-A-2001-273953

However, with the use of the plug made 100 percent of rubber, the shaking of the terminal increases with aged deterioration such as contraction of the plug, and besides the liquid intrusion prevention performance is lowered with this aged deterioration.

SUMMARY OF THE INVENTION

This invention has been made in view of the above circumstances, and an object of the invention is to provide a plug which can reduce adverse effects of its aged deterioration on a terminal shaking prevention performance and a liquid intrusion prevention performance, and another object is provide a waterproof connector provided with the plugs.

In order to accomplish the above object, a plug and a waterproof connector with a plug of the invention is characterized by having the following arrangement.

(1) A plug for a waterproof connector that includes a connector housing and holds a wire that is passed through the connector housing, the plug comprising:

an annular resin member that is received in the connector housing;

a first annular elastic rubber member that is molded integrally with an inner surface of the resin member and is adapted to be held in contact with the wire; and a second annular elastic rubber member that is molded integrally with an outer surface of the resin member and is adapted to be held in contact with the connector housing, wherein the resin member is disposed between the first and the second rubber members, and the first and the second rubber members are molded integrally.

(2) A plug according to (1), wherein the resin member comprises a terminal holding portion that projects from one end surface of the rubber member and is adapted to hold a terminal connected to the wire, and a pillar portion that is exposed to the other end surface of the rubber member and is adapted to abut against a cover covering the connector housing.

(3) A plug according to (2), wherein an end surface of the pillar portion that abuts against the cover is disposed flush with the other end surface of the rubber member.

(4) A plug according to (2), wherein the resin member comprises a plurality of the pillar portions.

(5) A plug according to (1), wherein an inner surface of the first rubber member and an outer surface of the second rubber member have uneven shape, respectively.

(6) A plug according to (1), wherein the resin member is formed with a through hole through which the first and the second rubber members are molded integrally.

(7) A waterproof connector comprising:

a connector housing;

a receiving chamber formed within the connector housing;

a wire passed through the receiving chamber; and a plug received in the receiving chamber and comprising an annular elastic rubber member, an inner surface of the rubber member held in contact with the wire, an outer surface of the rubber member held in contact with the receiving chamber, and an annular resin member that is molded integrally with the rubber member in concentric relation to the rubber member.

(8) A waterproof connector according to (7) further comprising a cover that is attached to the connector housing and covers a portion of the receiving chamber that accords to the plug.

(9) A waterproof connector according to (8), wherein the resin member comprises a terminal holding portion that projects from an end surface of the rubber member and holds a terminal connected to the wire, and a pillar portion that is exposed to the other end surface of the rubber member and abuts against the cover.

(10) A waterproof connector according to (9), wherein an end surface of the pillar portion abutting against the cover is disposed flush with the other end surface of the rubber member.

(11) A waterproof connector according to (8), wherein the cover holds a terminal connected to the wire through the plug.

According to the invention, unlike a plug made entirely of rubber, the plug of the construction includes the resin member molded integrally with the rubber member, and therefore this plug is less susceptible to adverse effects of aged deterioration such as contraction. Therefore, a good terminal shaking prevention performance, as well as a good liquid intrusion prevention performance, can be maintained for a long period of time.

According to the invention, the resin member includes the terminal holding portion projecting from the rubber member so as to be directed toward the terminal to be pressed against the terminal to thereby hold this terminal, and the pillar portions for abutment against the inner surface of the cover. Therefore, the withdrawal of the terminal from the terminal receiving chamber that is, the movement of the terminal toward the other end portion of the wire is prevented, and also the shaking of the terminal is prevented in a stable manner.

According to the invention, not only the end surfaces of the pillar portions but also the end surface of the rubber member abut against the cover, and therefore the shaking prevention effect is enhanced, thereby preventing the shaking of the terminal in a more stable manner.

According to the invention, the adverse effects of the aged deterioration of the plug on the terminal shaking prevention performance and the liquid intrusion prevention performance can be reduced.

DETAIL DESCRIPTION OF PREFERRED EMBODIMENTS

A preferred embodiment of the present invention will now be described in detail with reference to the drawings.

Figure 1:
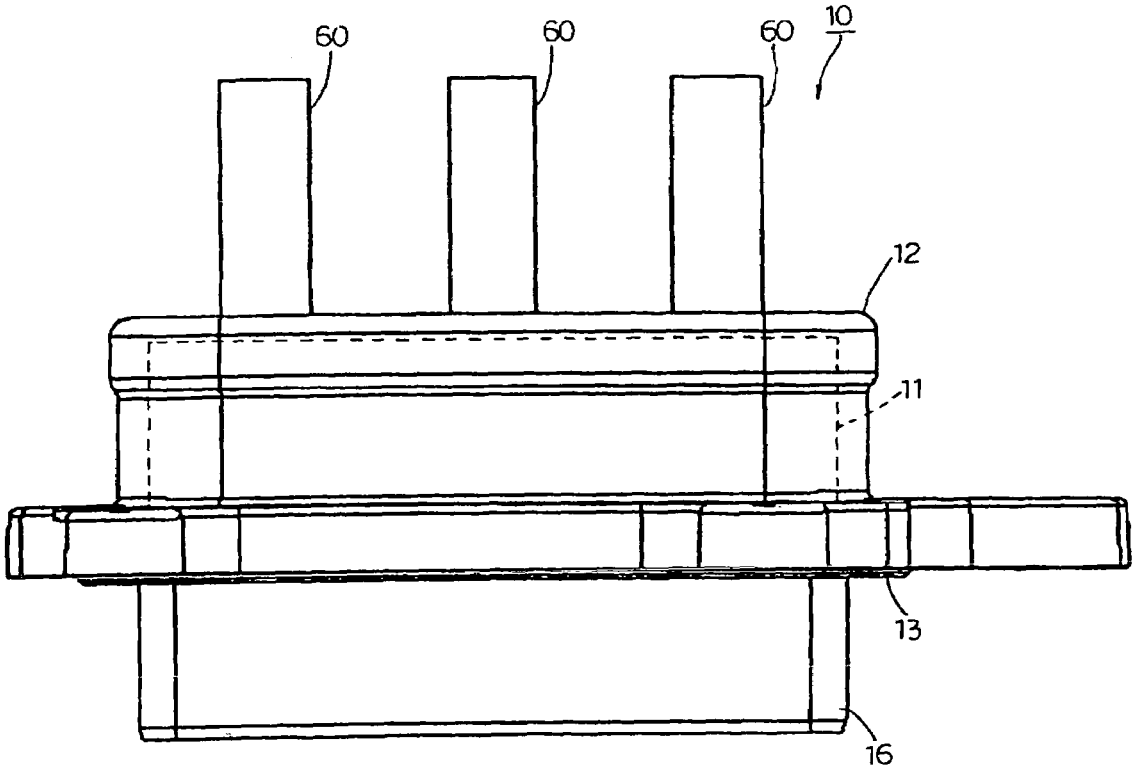
FIG. 1 is a front-elevational view of one preferred embodiment of a plug-equipped waterproof connector of the present invention.
Figure 2:
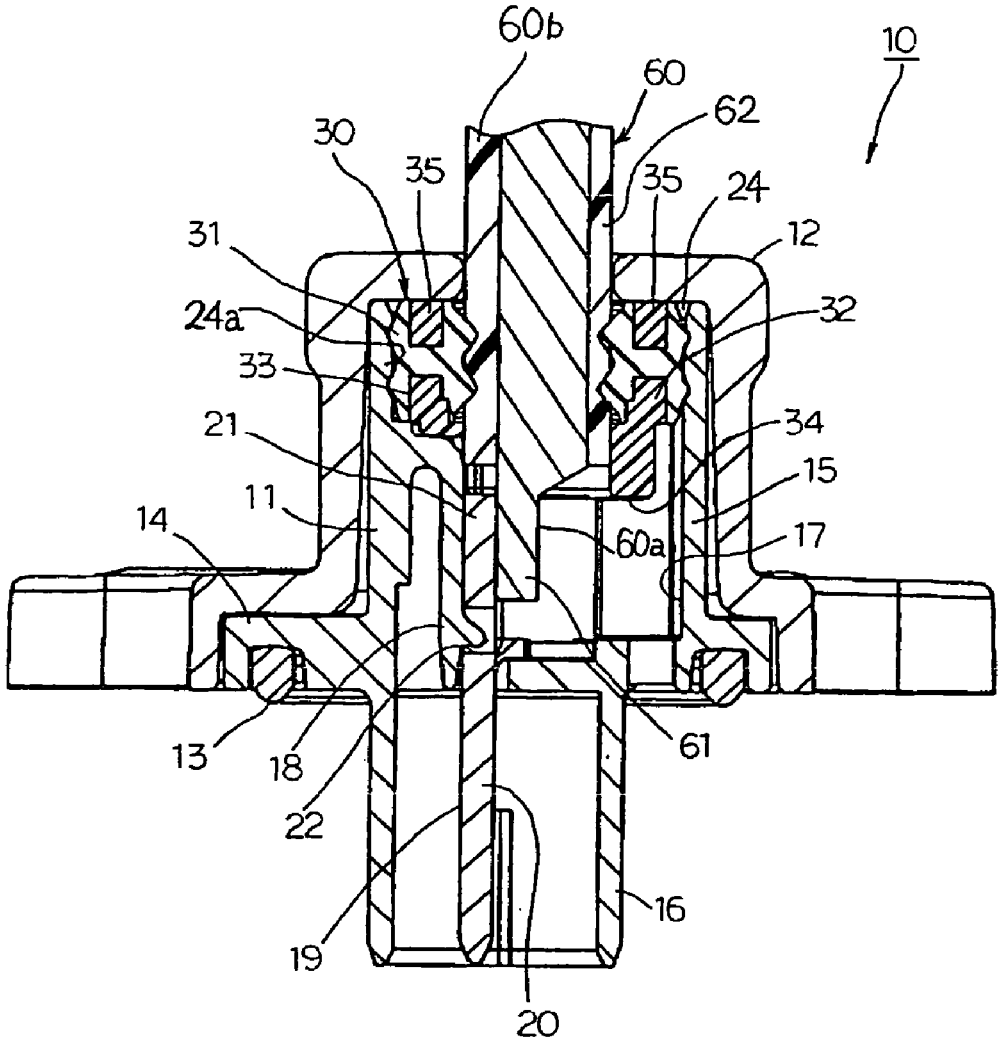
FIG. 2 is a vertical cross-sectional view of the waterproof connector of FIG. 1.
Figure 3:
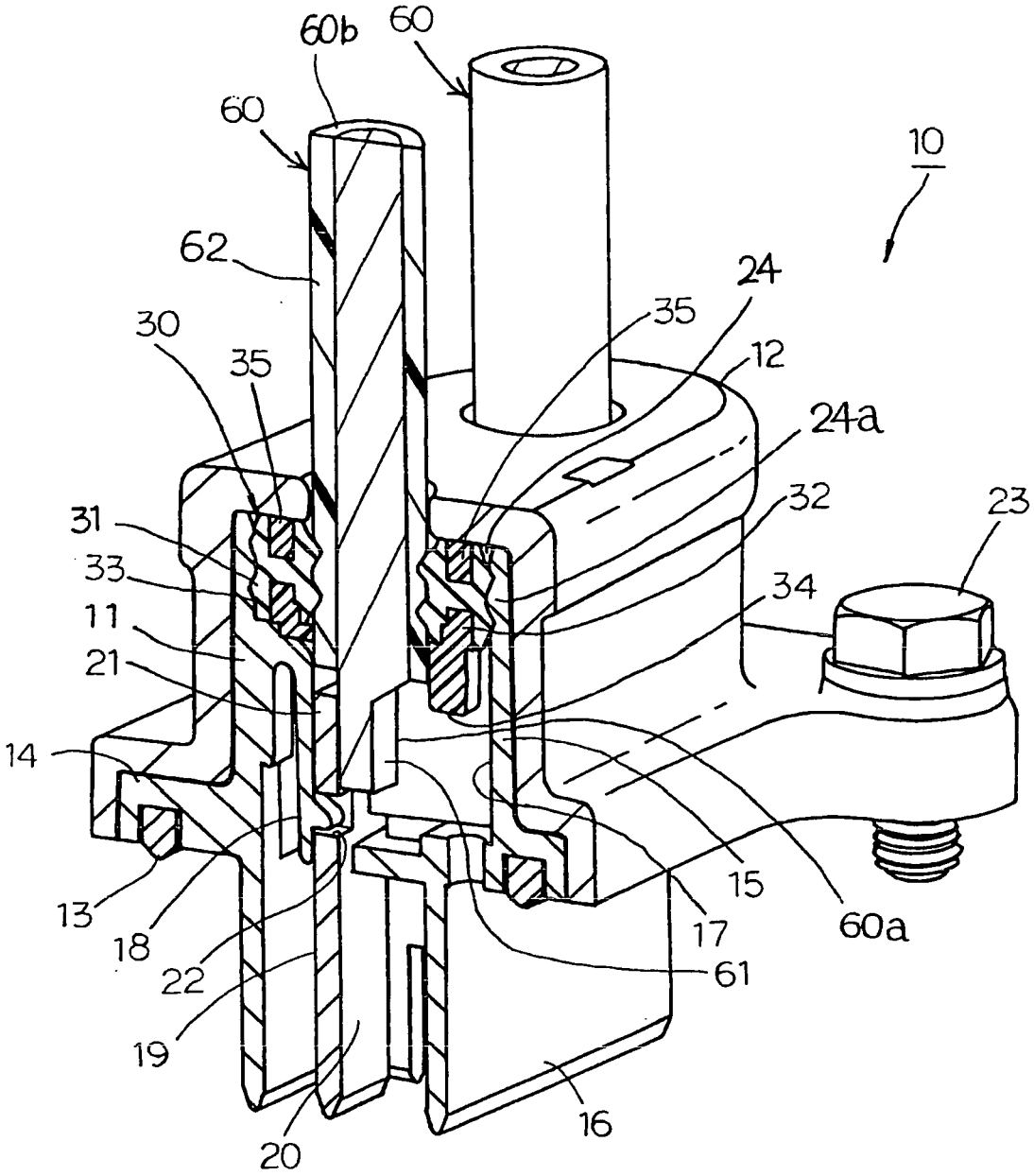
FIG. 3 is a partly cross-sectional, perspective view of the waterproof connector of FIG. 2, showing its appearance.
Figure 4:
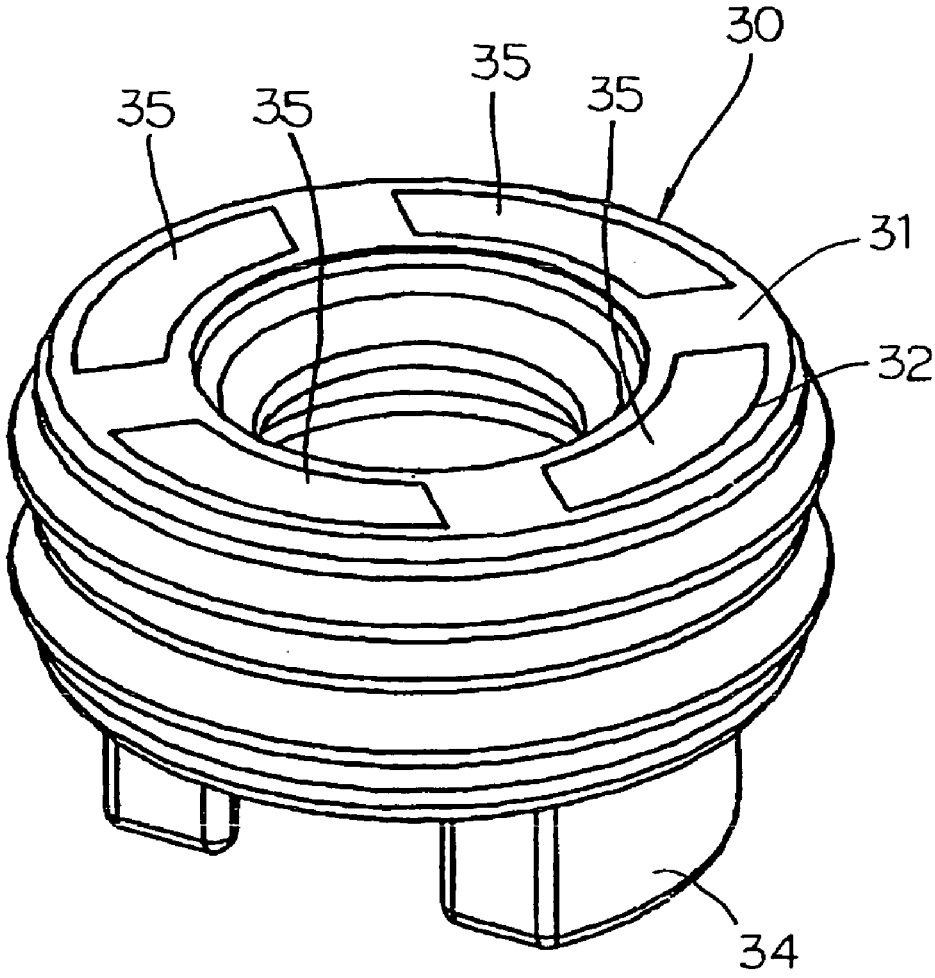
FIG. 4 is a perspective view of a plug used in the waterproof connector of FIG. 1, showing its appearance.
Figure 5:
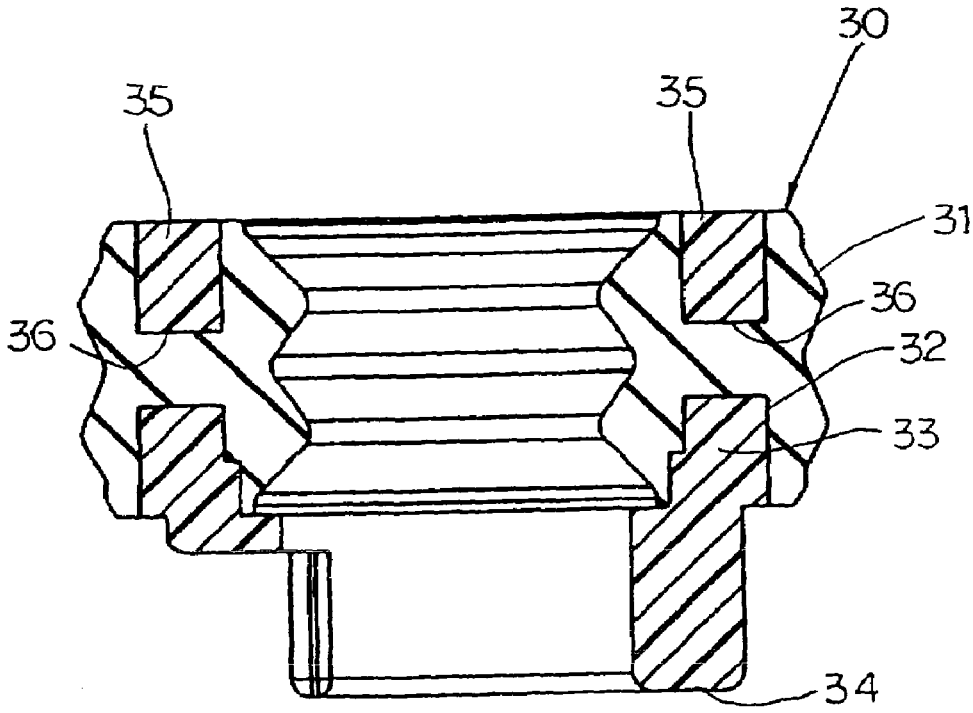
FIG. 5 is a vertical cross-sectional view of the plug of FIG. 4.
Figure 6:
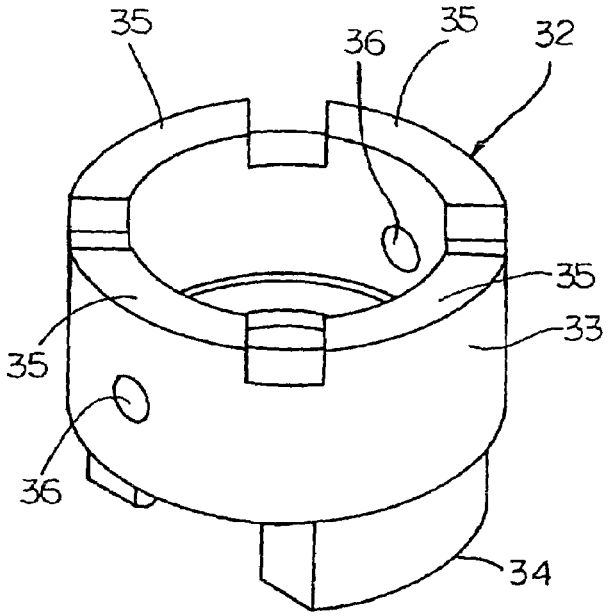
FIG. 6 is a perspective view of a resin member of the plug of FIG. 4, showing its appearance.
Figure 7:
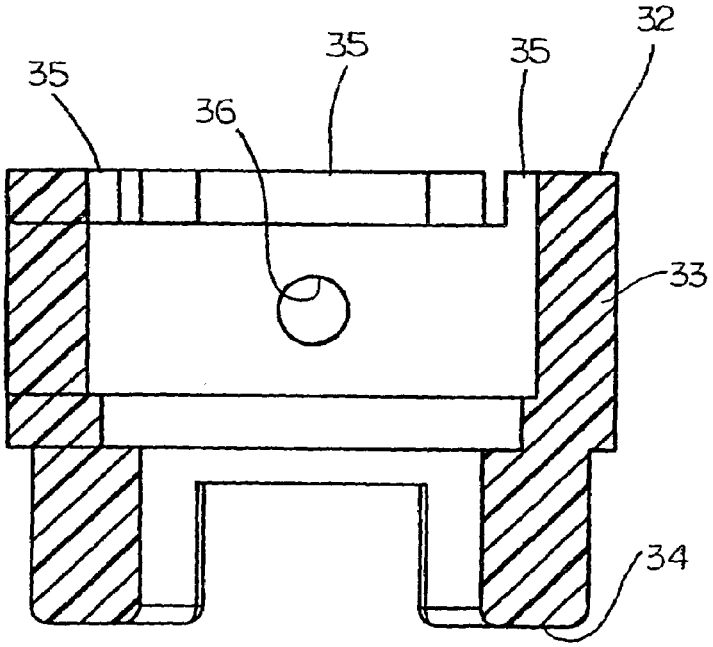
FIG. 7 is a vertical cross-sectional view of the resin member of FIG. 6.
Figure 8A:
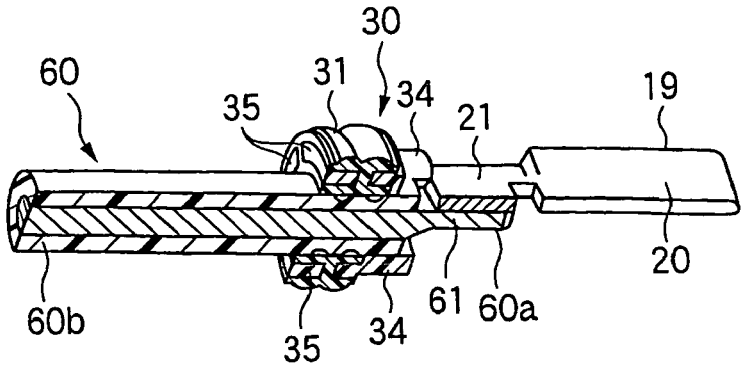
FIG. 8A is a cross-sectional view showing the plug, shown in FIGS. 2 to 7, attached to a terminal-equipped wire.
Figure 8B:
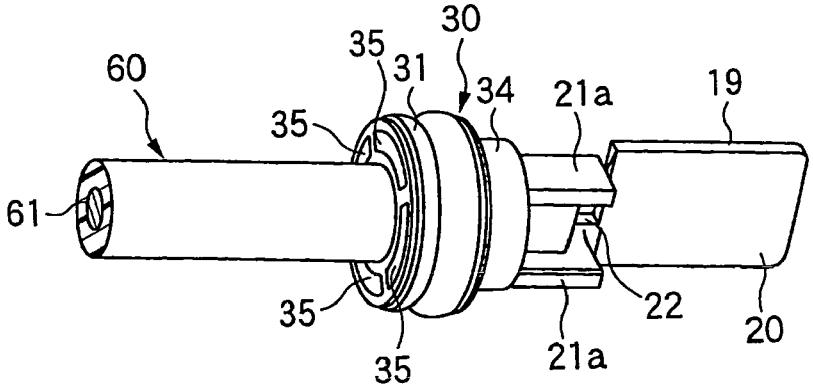
FIG. 8B is a perspective view showing the plug, shown in FIGS. 2 to 7, attached to the terminal-equipped wire.
Figure 8C:
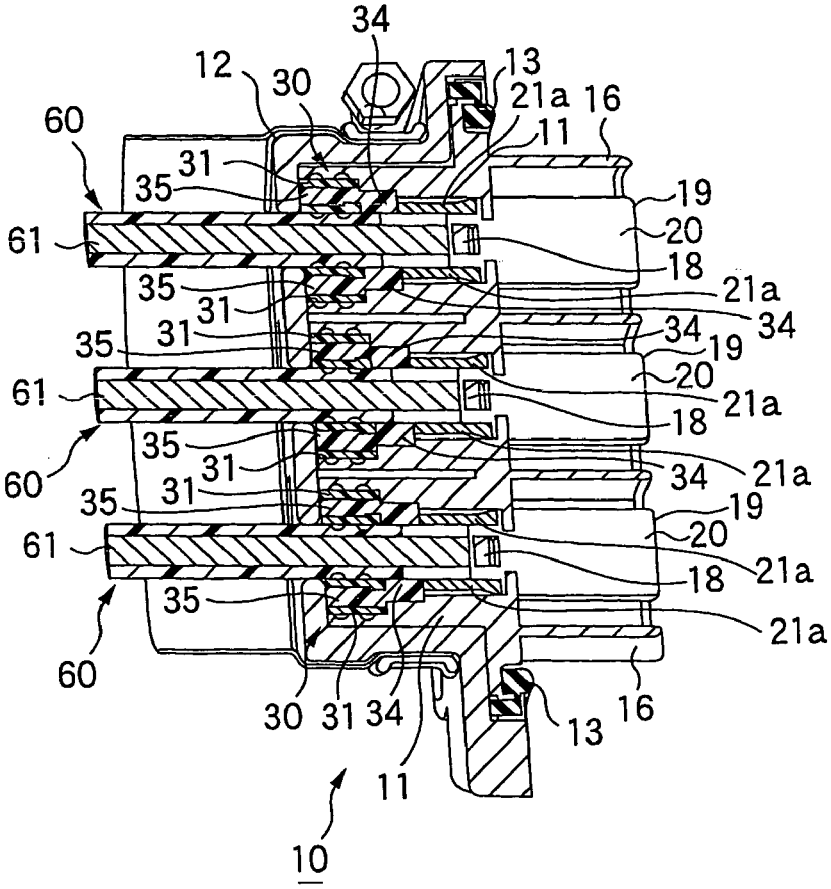
FIG. 8C is a cross-sectional view of the waterproof connector of FIG. 1 through a plane perpendicular to the cross-section of FIG. 2.

FIG. 1 is a front-elevational view of one preferred embodiment of a plug-equipped waterproof connector of the present invention, FIG. 2 is a vertical cross-sectional view of the waterproof connector of FIG. 1, FIG. 3 is a partly cross-sectional, perspective view of the waterproof connector of FIG. 2, showing its appearance, FIG. 4 is a perspective view of a plug used in the waterproof connector of FIG. 1, showing its appearance, FIG. 5 is a vertical cross-sectional view of the plug of FIG. 4, FIG. 6 is a perspective view of a resin member of the plug of FIG. 4, showing its appearance, FIG. 7 is a vertical cross-sectional view of the resin member of FIG. 6, FIG. 8A is a cross-sectional view showing the plug, shown in FIGS. 2 to 7, attached to a terminal-equipped wire, FIG. 8B is a perspective view showing the plug, shown in FIGS. 2 to 7, attached to the terminal-equipped wire, and FIG. 8C is a cross-sectional view of the waterproof connector of FIG. 1 through a plane perpendicular to the cross-section of FIG. 2.

As shown in FIG. 1, the plug-equipped waterproof connector 10 of the invention comprises a connector housing 11 made of a synthetic resin, a shell (or a cover) 12 which is made of metal such as aluminum and is fitted on the connector housing 11 to cover the same, and a damper 13 made of rubber. Three wires 60 are extended outwardly from the waterproof connector 10.

As shown in FIGS. 2 to 8C, more specifically, this waterproof connector 10 includes the connector housing 11, terminal receiving chambers 17 formed within the connector housing 11, male terminals 19 received respectively in the terminal receiving chambers 17, the wires 60 each of which includes a conductor 61 electrically connected to the corresponding terminal 19 at its one end portion 60*a*, and has the other end portion 60*b* disposed exteriorly of the connector housing 11, plug receiving chambers 24 having an annular shape, which are formed within the connector housing 11 in surrounding relation respectively to outer peripheral surfaces of insulating sheaths 62 of the wires 60 and are disposed adjacent respectively to the terminal receiving chambers 17 in the longitudinal direction of the wires 60, the plugs 30 received respectively in the plug receiving chambers 24, and the shell (cover) 12 which is attached to the connector housing 11 from a side of the other end portions 60b of the wires 60 and covers the plug receiving chambers 24. The plug 30 comprises an elastic rubber member 31 having an annular shape and the annular resin member 32 molded integrally with the rubber member 31 in concentric relation thereto. An inner peripheral surface of the rubber member 31 is held in contact with a part of the outer peripheral surface of the insulating sheath 62 of the wire 60 over an entire periphery thereof, while an outer peripheral surface of the rubber member 31 is held in contact with an inner peripheral surface of a peripheral wall 24*a* of the plug receiving chamber 24, which forms outline of this plug receiving chamber 24, over an entire periphery thereof. The resin member 32 includes a terminal holding portion 34 for holding the terminal 19, and pillar portions 35 for abutting against an inner surface of the shell (cover) 12. The terminal holding portion 34 projects from the rubber member 31 toward the terminal 19 to be pressed against the terminal 19. The pillar portions 35 are partially exposed to an end surface of the rubber member 31 positioned at a side of the other end portion 60*b* of the wire 60. More specifically, the exposed end surfaces of the pillar portions 35 which are positioned at a side of the other end portion 60*b* of the wire 60 so as to abut against the inner surface of the shell (cover) 12 are disposed flush with the end surface of the rubber member 31 positioned at a side of the other end portion 60*b* of the wire 60.

Details of the waterproof connector 10 of this construction will be described below.

The connector housing 11 of the waterproof connector 10 includes a receiving portion 15 having a hollow tubular shape formed on and projecting upwardly from a flat plate-like base 14. A mating connector fitting portion 16 having a hollow tubular shape is formed on and projects downwardly from the base 14. The three plug receiving chambers 24 as well as the three terminal receiving chambers 17 are formed within the receiving portion 15 in such a manner that the terminal receiving chambers 17 are disposed adjacent to and communicate with the plug receiving chambers 24, respectively. A lance 18 is formed in a projected manner within each terminal receiving chamber 17. The annular damper 13 is mounted on the lower surface of the base 14 in surrounding relation to the mating connector fitting portion 16.

The three terminals 19 are received in the terminal receiving chambers 17, respectively. Each terminal 19 includes an electrical contact portion 20 which is formed at a distal end thereof so as to be electrically connected to a terminal (not shown) received within a mating connector (not shown), and a wire connection portion 21 having a U-shape which is formed at a basal end thereof and is electrically connected to the conductor 61 of the wire 60. The wire connection portion 21 includes a base portion for electrical connection to the conductor 61 of the wire 60 and a pair of upstanding piece portions 21*a* extending perpendicularly respectively from opposite side edges of this base portion. The terminal 19 has an engagement hole 22 formed between the electrical contact portion 20 and the wire connection portion 21. When a projection on the lance 18 is inserted into the engagement hole 22, the terminal 19 is retained in the terminal receiving chamber 17. The plug 30 is mounted in the plug receiving chamber 24 disposed above the terminal receiving chamber 17.

The rubber member 31 of the plug 30 has two annular projections formed on an inner peripheral surface thereof and is fitted on the wire 60. The rubber member 31 also has two annular projections formed on an outer peripheral surface thereof and is fitted in the inner peripheral surface of the peripheral wall 24*a* of the plug receiving chamber 24. Thus, the inner and outer peripheral surfaces of the rubber member 31 have uneven shape such as corrugated shape, and therefore can be held in contact respectively with the wire 60 and the peripheral wall 24*a* of the plug receiving chamber 24 with a large frictional force.

The resin member 32 of the plug 30 is made of a synthetic resin, and is higher in rigidity than the rubber member 31. The resin member 32 is disposed between the inner and outer peripheral surfaces of the rubber member 31, and therefore will not contact the wire 60 and the connector housing 11. The resin member 32 has the terminal holding portion 34 projecting downwardly from a lower end of an annular body 33 thereof. The terminal holding portion 34 abuts against the distal end of the wire connection portion 21 of the terminal 19, received in the terminal receiving chamber 17, to hold the terminal 19 retained by the lance 18 against displacement, thereby eliminating the shaking of the terminal 19 with respect to the connector housing 11. Thus, the terminal holding portion 34 is a part of the resin member 32 having high rigidity, and therefore can positively hold the terminal 19.

The shell 12 is attached to the connector housing 11 to cover the receiving portion 15 and the upper surface of the base 14. The shell 12 has screw holes (not shown) and is fixed to the connector housing 11 with the base 14 by bolts 23 each threaded through the corresponding screw holes as shown in FIG. 3. The shell 12 also functions as a rear holder, and holds the terminals 19 through the plugs 30.

As shown in FIG. 4, the plug 30 has the four pillar portions 35 formed on the upper surface of the body 33 of the resin member 32, and each of the pillar portions 35 has a curved shape defined by an arc of a predetermined angle. The pillar portions 35 are spaced from one another in the circumferential direction of the rubber member 31, and are arranged at equal intervals. The terminal holding portion 34 has an arcuate shape, and projects downwardly from the lower surface of the body 33.

As shown in FIG. 5, the amount of the rubber member 31, contained in the plug 30, is reduced because of the provision of the resin member 32 for the plug 30, and therefore even when aged deterioration such as contraction develops in the rubber member 31, the amount of contraction of the plug 30 in the radial direction is so small that a liquid intrusion prevention performance will not be lowered.

As shown in FIGS. 6 and 7, through holes 36 into which the rubber, forming the rubber member, flows are formed through the body 33 of the resin member 32. The inner and outer peripheral surfaces of the rubber member 31 are molded integrally and connected through the through holes 36. The terminal holding portion 34 is larger in thickness than the body 33. FIGS. 8A to 8C and particularly FIG. 8C clearly show a condition in which the pillar portions 35 of the resin member 32 of each plug 30 abut against the inner surface of the shell (cover) 12, and the terminal holding portion 34 of the resin member 32 of the plug 30 abuts against the end of the wire connection portion 21 of the terminal 19 received in the terminal receiving chamber 17.

As described above, the waterproof connector 10 is provided with the plugs 30, which are different from a plug made entirely of rubber, each including the resin member 32 molded integrally with the rubber member 31, and therefore this waterproof connector 10 is less susceptible to adverse effects of aged deterioration such as contraction. The good shaking prevention performance with respect to the terminals 19, as well as the good liquid intrusion prevention performance with respect to the terminal receiving chambers 17, can be maintained for a long period of time.

And besides, in the waterproof connector 10, the resin member 32 of each of the plugs 30 includes the terminal holding portion 34 projecting from the rubber member 31 toward the terminal 19 to be pressed against the terminal 19 to thereby hold this terminal 19 and the pillar portions 35 abutting against the inner surface of the shell (cover) 12 which is attached to the connector housing 11 from a side of the other end portions 60*b* of the wires 60 and covers the plug receiving chambers 24. Therefore, the withdrawal of each terminal 19 from the terminal receiving chamber 17 that is, the movement of the terminal 19 toward the other end portion 60*b* of the wire 60 is prevented, and also the shaking of the terminal 19 is prevented in a stable manner.

Furthermore, in the waterproof connector 10, not only the end surfaces of the pillar portions 35 but also the end surface of the rubber member 31 abut against the shell (cover) 12, and therefore the shaking prevention effect is enhanced, thereby preventing the shaking of each terminal 19 in a more stable manner.

The present invention is not limited to the above embodiment, and suitable modifications, improvements and so on can be made. The material, shape, dimensions, numerical values, form, number, disposition, etc., of each of the constituent elements of the above embodiment are arbitrary, and are not limited in so far as the invention can be achieved.

Figure 9:
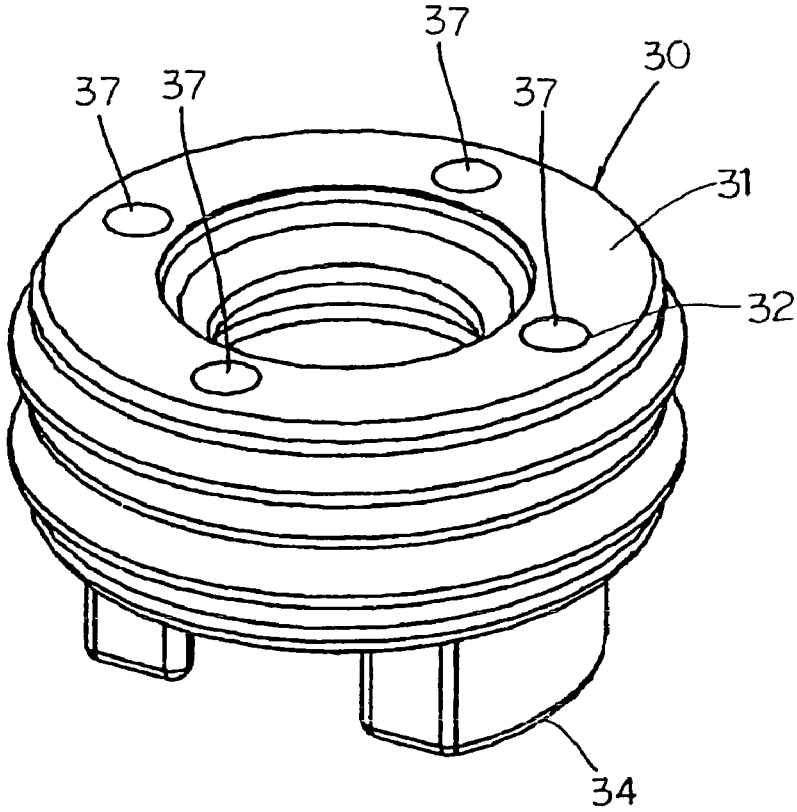
FIG. 9 is a perspective view of a modified example of the plug of FIG. 4, showing its appearance.

For example, the plug 30 can be modified as shown in FIG. 9. In FIG. 9, those portions similar to those of the plug 30 of the above embodiment will be designated by identical reference numerals, respectively, and explanation thereof will be briefly made or omitted. In this modified plug 30 shown in FIG. 9, four pillar portions 37 having a cylindrical shape are formed on an upper surface of a body 33 of a resin member 32, and are disposed respectively at predetermined angular positions in a circumferential direction. The pillar portions 37 are spaced from one anther in the circumferential direction of a rubber member 31. Effects and advantages of the plug 30 of FIG. 9 will be readily appreciated from the foregoing description, and therefore explanation thereof will be omitted.

Figure 10A:
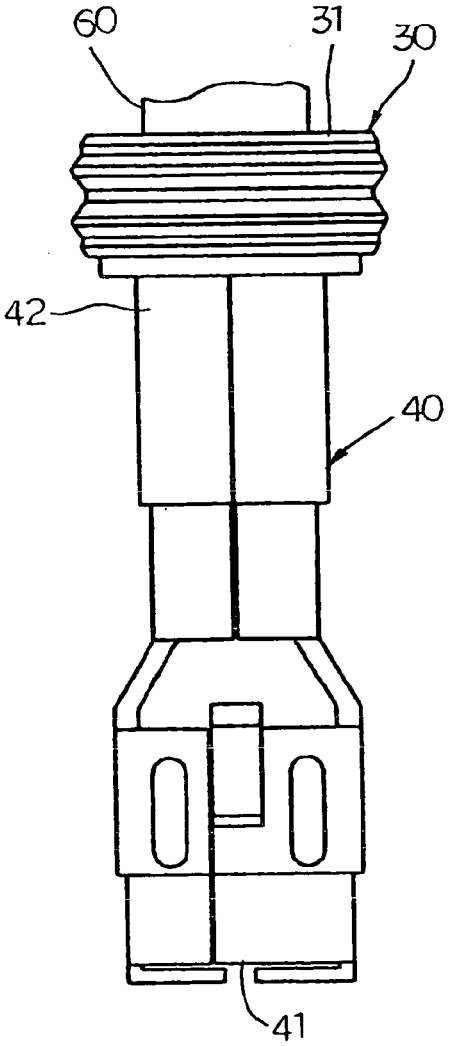
FIG. 10A is a plane view of an applied example employing the plug of FIG. 4.
Figure 10B:
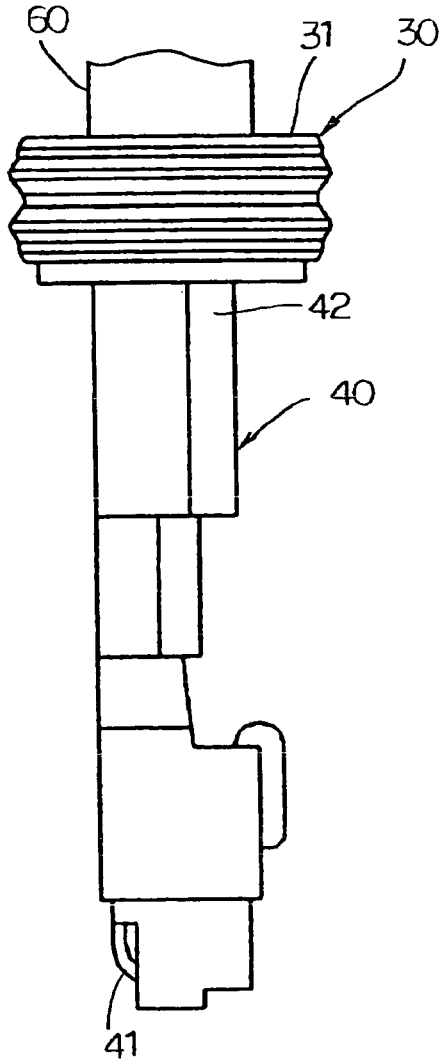
FIG. 10B is a side-elevational view of the applied example of FIG. 10A.

As shown in an applied example of FIGS. 10A and 10B, female terminals 40, each formed by bending an electrically-conductive metal sheet, can be used instead of the above terminals 19. The terminal 40 includes a bent resilient electrical connection portion 41 formed at a distal end portion thereof, and a wire connection portion 42 having a square tubular shape formed at a basal end portion thereof to which a conductor (not shown) of a wire 60 is electrically connected. The plug 30 is fitted on the wire connection portion 42 and an end portion of the wire 60. Effects and advantages of the applied example of FIGS. 10A and 10B will be readily appreciated from the foregoing description, and therefore explanation thereof will be omitted.

The number of the pillar portions of the resin member is not limited to four, and can be two or more, taking the easy molding operation into consideration. The pillar portion can have any other suitable shape. Further, the number of the wires as well as the number of the terminals, is suitably determined in accordance with a circuit construction to which the waterproof connector is applied.

What is claimed is:

1. A plug for a waterproof connector that includes a connector housing and holds a wire that is passed through the connector housing, the plug comprising:

an annular resin member that is received in the connector housing;

a first annular elastic rubber member that is molded integrally with an inner surface of the resin member and is adapted to be held in contact with the wire; and a second annular elastic rubber member that is molded integrally with an outer surface of the resin member and is adapted to be held in contact with the connector housing, wherein the resin member is disposed between the first and the second rubber members, and the first and the second rubber members are molded integrally, wherein the resin member comprises a terminal holding portion that projects from one end surface of the rubber member and is adapted to abut against an end of a terminal connected to the wire.

2. A plug according to claim 1, wherein an inner surface of the first rubber member and an outer surface of the second rubber member have uneven shape, respectively.

3. A plug according to claim 1, wherein the resin member is formed with a through hole through which the first and the second rubber members are molded integrally.

4. A plug according to claim 1, wherein the resin member comprises a pillar portion that is exposed to the other end surface of the rubber member and is adapted to abut against a cover covering the connector housing.

5. A plug according to claim 4, wherein an end surface of the pillar portion that abuts against the cover is disposed flush with the other end surface of the rubber member.

6. A plug according to claim 4, wherein the resin member comprises a plurality of the pillar portions.

7. A waterproof connector comprising:

a connector housing;

a receiving chamber formed within the connector housing;

a wire passed through the receiving chamber; and a plug received in the receiving chamber and comprising an annular elastic rubber member, an inner surface of the rubber member held in contact with the wire, an outer surface of the rubber member held in contact with the receiving chamber, and an annular resin member that is molded integrally with the rubber member in concentric relation to the rubber members, wherein the resin member comprises a terminal holding portion that projects from an end surface of the rubber member and abuts against an end of a terminal connected to the wire.

8. A waterproof connector according to claim 7 further comprising a cover that is attached to the connector housing and covers a portion of the receiving chamber that accords to the plug.

9. A waterproof connector according to claim 8, wherein the cover holds a terminal connected to the wire through the plug.

10. A waterproof connector according to claim 8, wherein the resin member comprises a pillar portion that is exposed to the other end surface of the rubber member and abuts against the cover.

11. A waterproof connector according to claim 10, wherein an end surface of the pillar portion abutting against the cover is disposed flush with the other end surface of the rubber member.

* * * * *